US007363659B1

(12) United States Patent
Colbert

(10) Patent No.: US 7,363,659 B1
(45) Date of Patent: Apr. 29, 2008

(54) JACKET AND BACKPACK ASSEMBLY

(76) Inventor: Misty Colbert, 2413 N. Lorraine, Wichita, KS (US) 67219

( * ) Notice: Subject to any disclaimer, the term of this patent is extended or adjusted under 35 U.S.C. 154(b) by 135 days.

(21) Appl. No.: 11/321,792

(22) Filed: Dec. 29, 2005

Related U.S. Application Data

(60) Provisional application No. 60/658,133, filed on Mar. 3, 2005.

(51) Int. Cl.
*A41D 3/02* (2006.01)

(52) U.S. Cl. ..... 2/86; 2/94

(58) Field of Classification Search ..... 2/94, 2/69.5, 72, 86, 88, 89; 224/153
See application file for complete search history.

(56) References Cited

U.S. PATENT DOCUMENTS

| | | | | |
|---|---|---|---|---|
| 2,165,348 | A * | 7/1939 | Daiber | 2/94 |
| 4,068,314 | A * | 1/1978 | Yellen et al. | 2/94 |
| 4,389,735 | A * | 6/1983 | McLaughlin | 2/94 |
| 4,404,687 | A * | 9/1983 | Hager | 2/94 |
| 4,563,777 | A * | 1/1986 | Park | 2/108 |
| 4,669,127 | A * | 6/1987 | Swanson | 2/46 |
| 4,689,831 | A * | 9/1987 | Greenberger et al. | 2/93 |
| 5,123,117 | A * | 6/1992 | Prendergast | 2/108 |
| 5,165,111 | A | 11/1992 | Lieberman | |
| 5,407,112 | A * | 4/1995 | Christodoulou et al. | 224/153 |
| 5,526,969 | A | 6/1996 | Greenberger | |
| 5,673,836 | A * | 10/1997 | Bush | 224/576 |
| 5,699,560 | A | 12/1997 | Greenberg | |
| 5,743,448 | A * | 4/1998 | Tsai | 224/153 |
| 5,852,828 | A * | 12/1998 | Foster | 2/102 |
| D403,836 | S | 1/1999 | Len | |
| 5,860,164 | A * | 1/1999 | Johnson | 2/94 |
| 5,909,802 | A * | 6/1999 | Puco et al. | 2/102 |
| 6,073,268 | A * | 6/2000 | Ziegler et al. | 2/94 |
| 6,131,199 | A * | 10/2000 | Bugel et al. | 2/102 |
| 6,134,712 | A | 10/2000 | Spector | |
| 6,315,178 | B1 * | 11/2001 | Nobata | 224/153 |
| 6,336,222 | B1 * | 1/2002 | Ware | 2/94 |
| 6,393,613 | B1 * | 5/2002 | Sheu | 2/94 |
| 6,405,377 | B1 | 6/2002 | Davis | |
| 6,564,388 | B1 | 5/2003 | Poston | |
| 6,751,806 | B2 * | 6/2004 | Hinnant | 2/108 |
| 7,000,255 | B1 * | 2/2006 | Baacke | 2/94 |
| 7,165,271 | B2 * | 1/2007 | Elen | 2/85 |
| 2003/0033658 | A1 * | 2/2003 | Hinnant | 2/93 |
| 2003/0205593 | A1 * | 11/2003 | Lavelle | 224/153 |
| 2005/0056669 | A1 * | 3/2005 | Lavelle | 224/153 |
| 2005/0091724 | A1 * | 5/2005 | Snyder et al. | 2/86 |
| 2005/0273904 | A1 * | 12/2005 | Valdes | 2/86 |

FOREIGN PATENT DOCUMENTS

| | | |
|---|---|---|
| EP | 86307711.1 | 7/1987 |
| WO | WO86/06939 | 12/1986 |

* cited by examiner

*Primary Examiner*—Alissa Hoey
(74) *Attorney, Agent, or Firm*—Kenneth H. Jack; David & Jack, L.L.C.

(57) ABSTRACT

A storage and clothing assembly having a jacket having a shoulder covering section, a right arm, a left arm, and a torso, the jacket being foldable between a wearing configuration and a compact configuration; the assembly further having a backpack having a pocket positioned at the backpack's wearer side and fitted for slidably receiving the jacket, the left and right shoulder straps being positioned for slidably receiving the jacket's left and right arms, the assembly further having button attachment panels for interconnecting the back of the jacket's shoulder section with a wall of the backpack's pocket.

5 Claims, 16 Drawing Sheets

JACKET AND BACKPACK ASSEMBLY

REFERENCE TO PREVIOUSLY FILED PROVISIONAL APPLICATION

The following non-provisional patent application is a continuation in part of, and claims priority from, and claims the benefit of the filing date of Provisional Patent Application No. 60/658,133 filed Mar. 3, 2005, with the U.S. Patent and Trademark Office. The inventor under said Application No. 60/658,133 and the inventor under the instant application are one and the same.

The sections of said Provisional Application entitled, "Field of the Invention", "Background of the Invention", and "Brief Description of the Drawings" are identical to similarly titled sections of the instant Application. The sections of the instant Application entitled, "Brief Summary of the Invention" and "Detailed Description of a Preferred Embodiment" slightly differ from similarly titled sections appearing in said Provisional Application. For purposes of easy identification of such differences, additional copies of the "Brief Summary of the Invention" and the "Detailed Description of a Preferred Embodiment" sections of the instant non-provisional application are submitted herewith, such additional copies notating the changes in a "line in-line out" format.

The informally presented Drawing FIGS. 1-16 of said Provisional Application are incorporated within and are identically presented as part of the instant non-provisional application.

FIELD OF THE INVENTION

This invention relates to clothing outer wear and personal article carrying bags, cases and the like. More particularly, this invention relates to assemblies composed of fabric, which assemblies are specially adapted for dually functioning both as outer wear and as an article storing and carrying receptacle.

BACKGROUND OF THE INVENTION

During cold weather months, school children typically wear a jacket or coat to school. Such children also commonly utilize canvas backpacks for carrying books and school supplies to and from school. In many cases, a child wearing a coat or jacket will have difficulty extending his or her left and right arms beneath the left and right shoulder straps of a backpack, and the child will have further difficulty correctly situating the backpack upon his or her back. Upon arriving at school, such child will commonly have further difficulty removing the backpack from his or her back. Thereafter, upon removing both the backpack and the coat or jacket, the child typically will either separately hang the coat and the backpack upon hooks in a cloak room, or upon a coat rack. On occasion, such child may hang the coat upon a coat hook and alternately separately store the backpack within the child's desk storage bin. As a result of such separate storage locations of coats and backpacks, the coats and backpacks often become separated. As a further result of such separation, the child, upon returning home from school, often will have forgotten his or her backpack, bringing home only the coat which is worn. In circumstances where the child remembers to retrieve his or her backpack at the end of a school day, the child typically must repeat the above described awkward and cumbersome process of extending arms beneath backpack shoulder straps and appropriately situating the backpack upon his or her back.

During transitional seasons between summer and fall and between winter and spring, school children commonly depart home for school wearing only shirt sleeves and carrying a backpack, such as described above, upon their backs. During such seasons, such children commonly will carry a coat or jacket within the main storage compartment of the backpack, as a precaution against unexpected weather changes. Such practice undesirably takes up needed space within the backpack, and such practice often presents or creates undesirable and uncomfortable lumps upon the side of the backpack which comes into contact with the wearer's back.

The instant inventive jacket and backpack assembly solves or ameliorates the problems set forth above by modifying the structures of both a common jacket and a common backpack so that those two articles may be worn as a unitary assembly, and so that the backpack may alternately store the jacket while utilizing the jacket as a backpack back cushioning element.

BRIEF SUMMARY OF THE INVENTION

A first major structural component of the instant inventive jacket and backpack assembly comprises a coat or jacket having a shoulder covering section, a torso covering portion, having left and right arms, and having a collar, the collar suitably including or supporting a hood. Preferably, the coat or jacket element further comprises left and right backpack shoulder strap engaging means, such means preferably being respectively fixedly attached to the jacket or coat at the frontal or anterior aspects of the coat's left and right shoulders. Preferably, the backpack shoulder strap attaching means comprises left and right flexible hook and loop pad combinations which are preferably fixedly sewn at the above described frontal positions upon the left and right shoulders of the jacket. Suitably, the shoulder strap attaching means may alternately comprise straps releasably looped by buttons, hooks, magnet attachments or snaps. Other fastening means which are capable of releasably interconnecting or closing a flexible loop are considered to fall within the scope of the invention.

A further structural component of the instant inventive jacket and backpack assembly comprises a canvas or fabric backpack preferably having left and right shoulder straps and having at least a first major storage compartment. The backpack element of the instant inventive assembly is preferably further configured to include an upwardly opening jacket receiving pocket, such pocket preferably being situated at the wearer side or back contact side of the backpack. The jacket receiving pocket is preferably fitted and sized substantially co-extensively with such wearer side or back contact side of the backpack, and is further fitted for slidable receipt of the jacket in its folded configuration.

A further component of the instant inventive jacket and backpack assembly comprises backpack and jacket attaching means, such means preferably being adapted for releasably interconnecting the backpack and the jacket at a pair of connection points, one of the connection points among such pair preferably being upon an interior wall of the jacket receiving pocket, such point being located near the pocket's upper opening, and the other contact point among such pair preferably being substantially centrally located upon the posterior aspect of the jacket's shoulders. The backpack and jacket connecting means preferably comprises a button and button hole assembly. Suitably, such assembly may alternately comprise snap fastener assemblies, velcro fastener assemblies, or magnet fastener assemblies. Other fabric attaching means which are suitable for alternately accomplishing releasable connections at the above described pair of contact points are considered to fall within the scope of the invention.

In a first usage configuration of the instant inventive jacket and backpack assembly, the arms of the jacket element are extended beneath the left and right shoulder straps of the backpack, and the jacket's left and right shoulder strap engaging means are manipulated so that they receive, engage, and securely hold the backpack's left and right shoulder straps. Thereafter, the backpack pocket and jacket attaching means is preferably manipulated to centrally interconnect the backpack and the upper rear shoulder portion of the jacket. In such first usage configuration, the jacket and the backpack may be donned, worn, removed, and stored upon a coat hook as a unitary assembly and in the manner of conventional jackets.

In a second or alternate usage configuration of the instant inventive jacket and backpack assembly, the shoulder strap engaging means are released, the jacket portion is foldably moved to a compact folded configuration forming a square or rectangular cushion element, and the newly formed jacket/cushion is manually slidably inserted into the backpack's jacket receiving pocket. In such usage configuration, the jacket/cushion element dually functions as a convenient and compactly stored jacket, ready for use in the event of an unexpected onset of cold weather, and as a backpack back cushioning element.

The above described structural elements described above, and their functions, constitute objects of the instant invention. Further objects, benefits, and advantages of the instant invention are set forth below in the Detailed Description of a Preferred Embodiment of the Invention, and in the appended drawings.

BRIEF DESCRIPTION OF THE DRAWINGS (Drawings FIGS. 1-16 which were presented upon the Mar. 3, 2005 filing of the Provisional Application No. 60/658,133 are incorporated herein by reference. For convenience of reference, photostatic copies of said originally submitted drawings are submitted herewith. Drawing FIGS. 1-16 continue to be submitted informally.)

Figure 2:
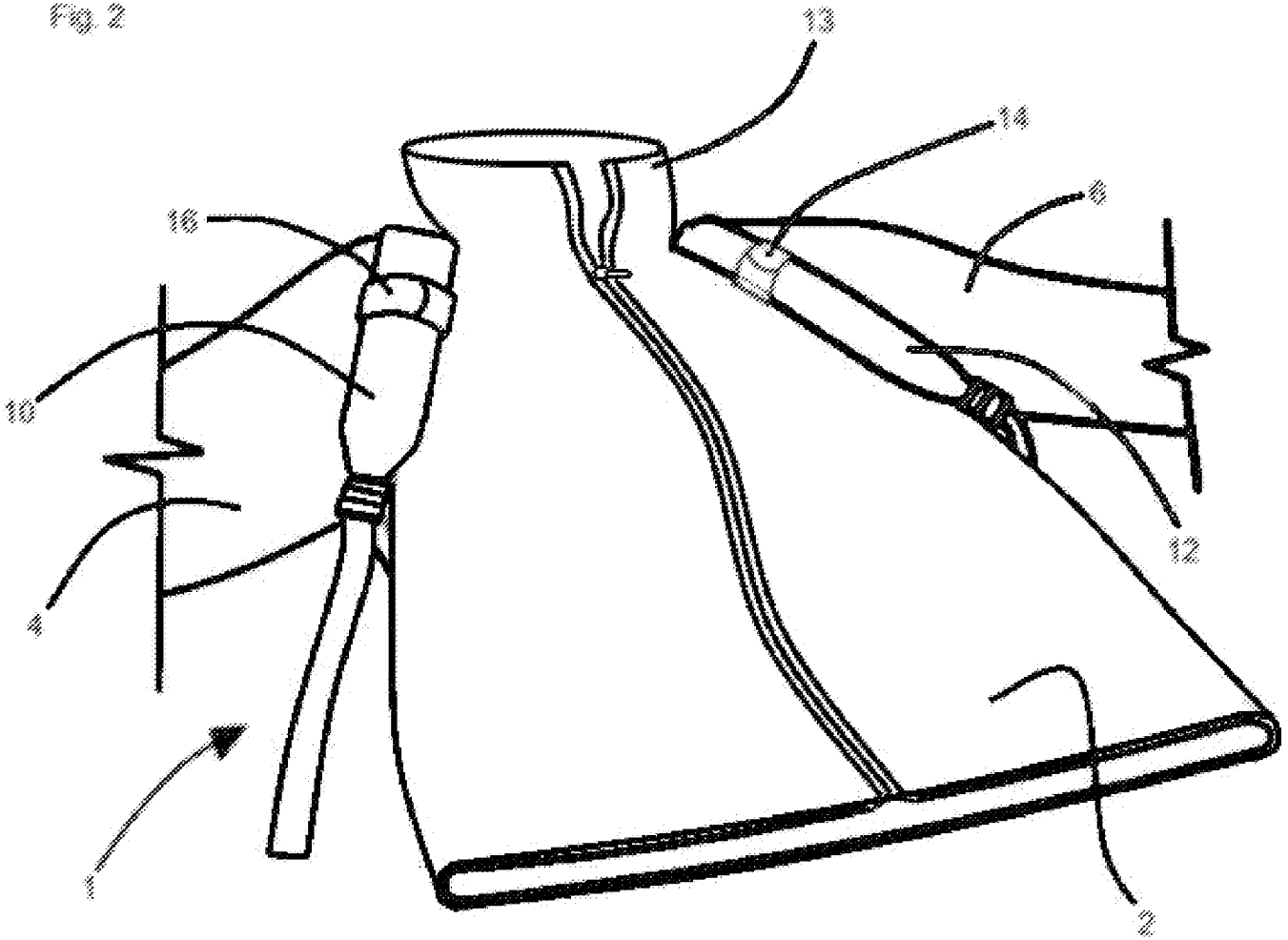
FIG. 2 is a perspective view and reverse view of the assembly depicted in FIG. 1.
Figure 4:
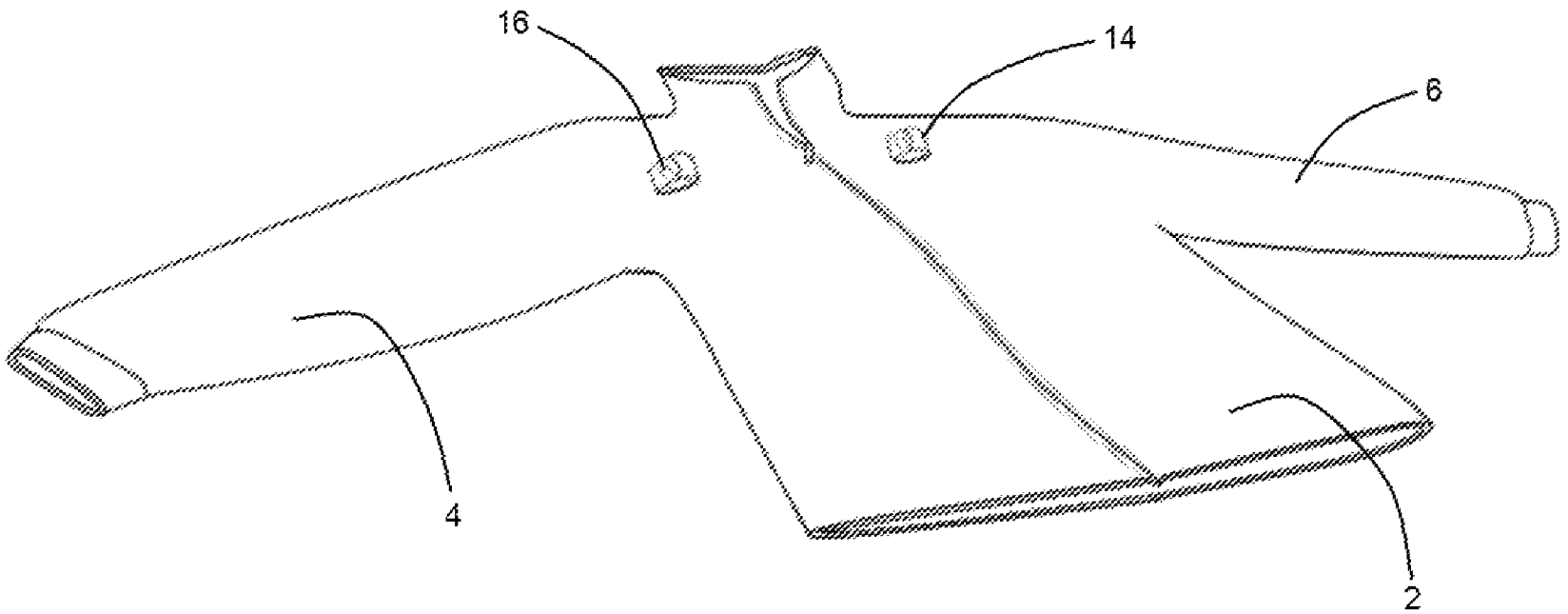

FIG. 4 redepicts FIG. 2, the view of FIG. 4 showing the backpack element removed.

Figure 5:
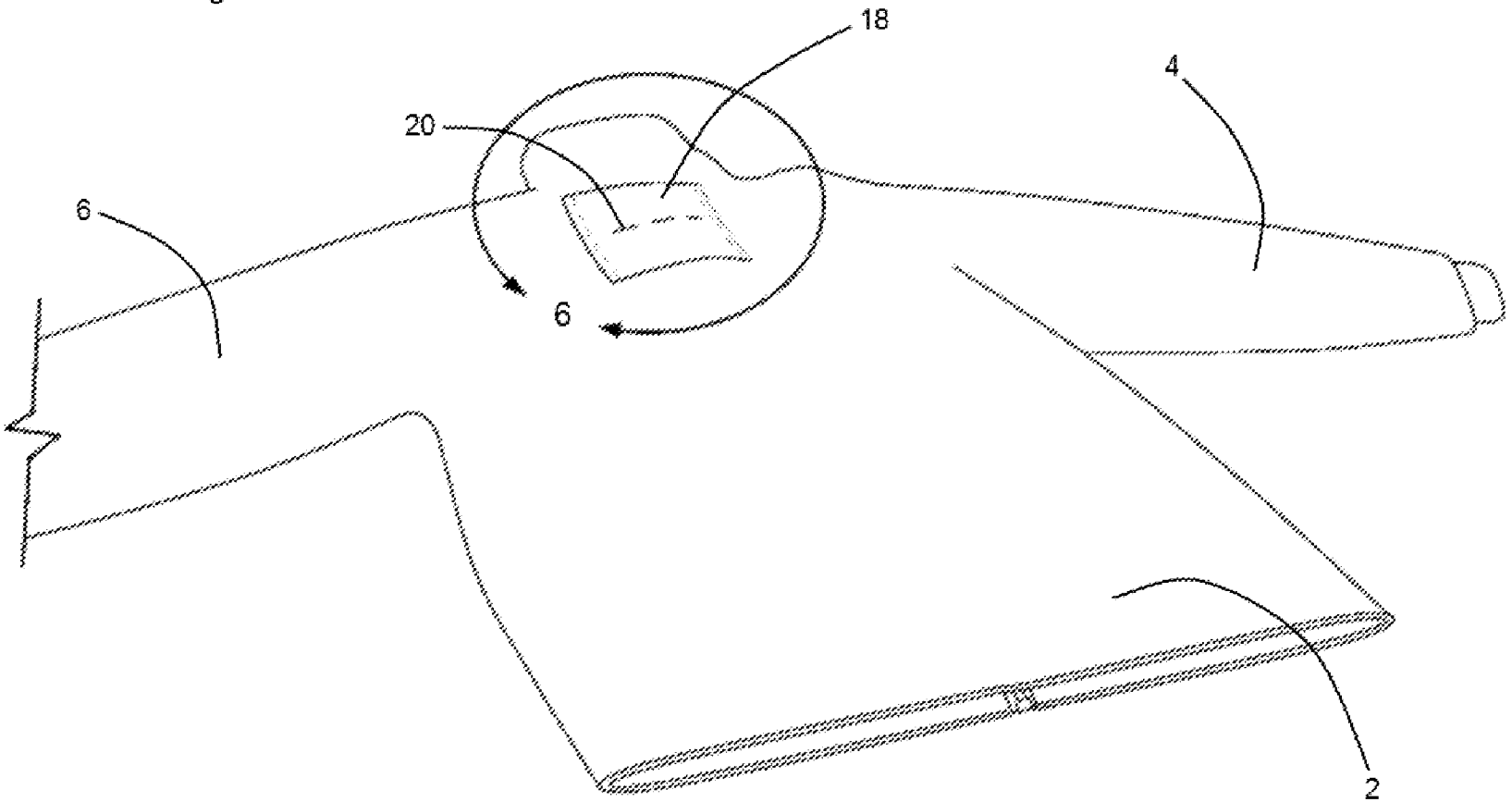

FIG. 5 is a reverse view of the structure depicted in FIG. 4.

Figure 6:
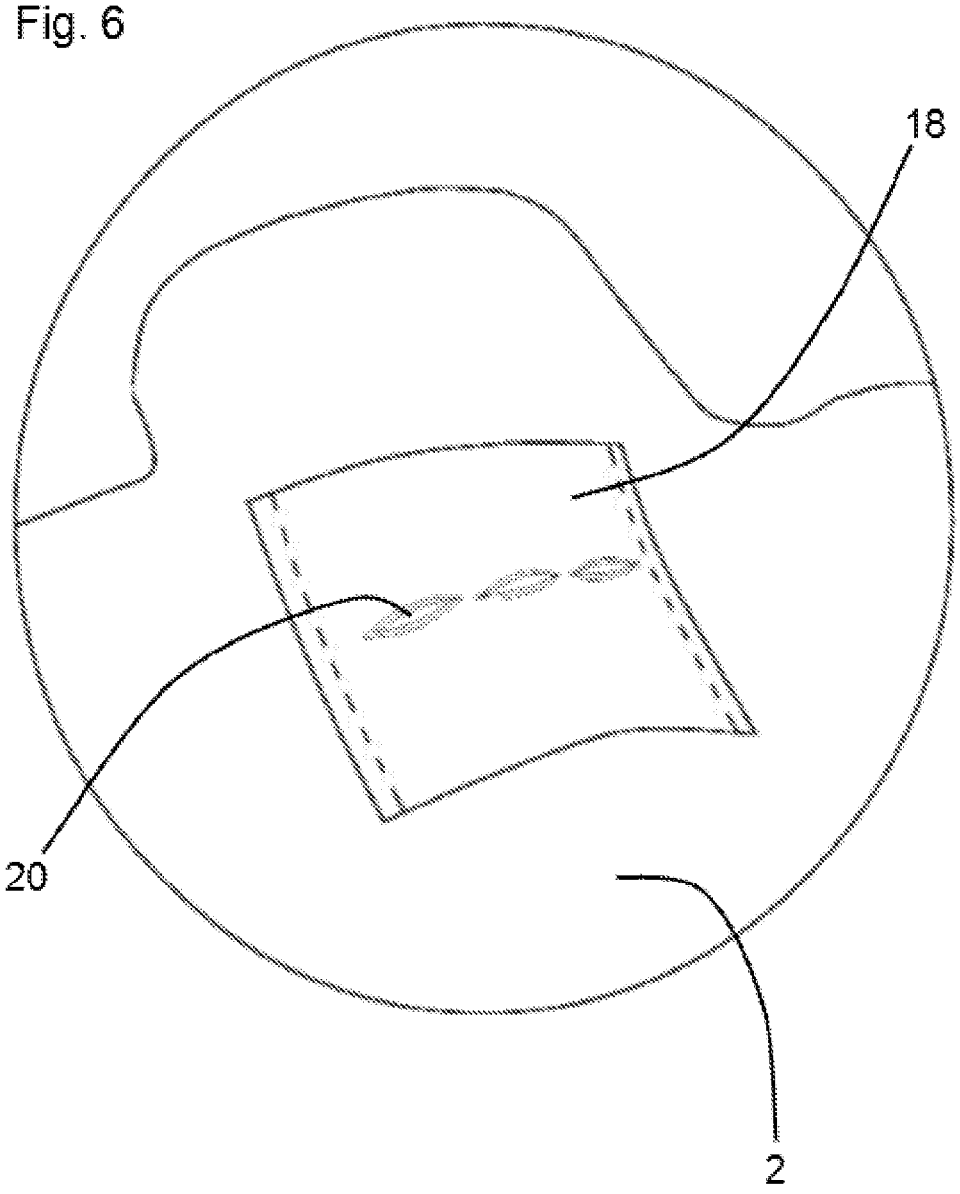

FIG. 6 is a magnified detail of a portion of the view of FIG. 5.

Figure 7:
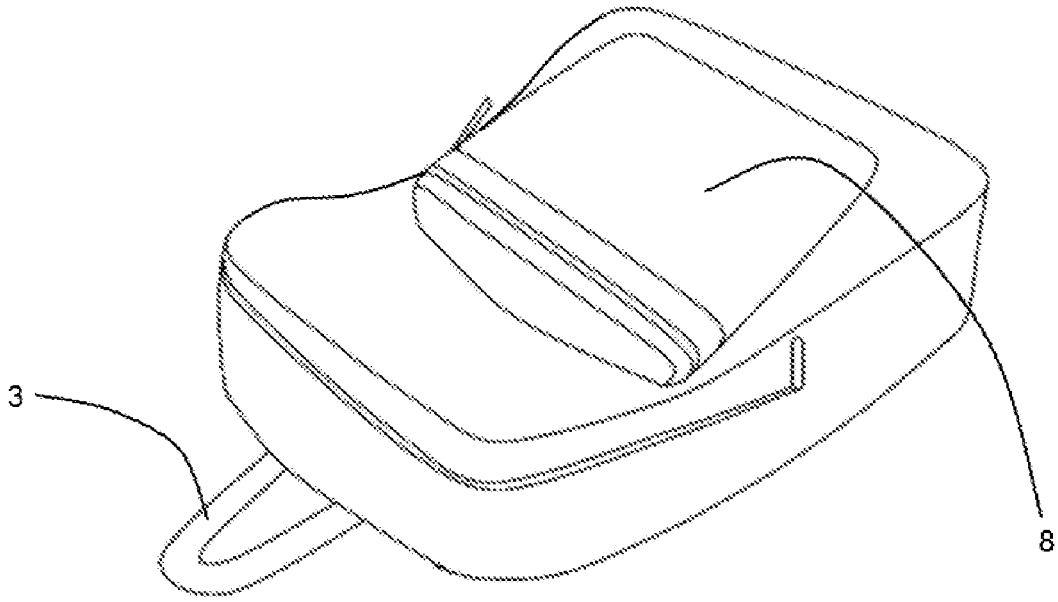

FIG. 7 is a perspective view of the backpack element of the instant inventive assembly.

Figure 8:
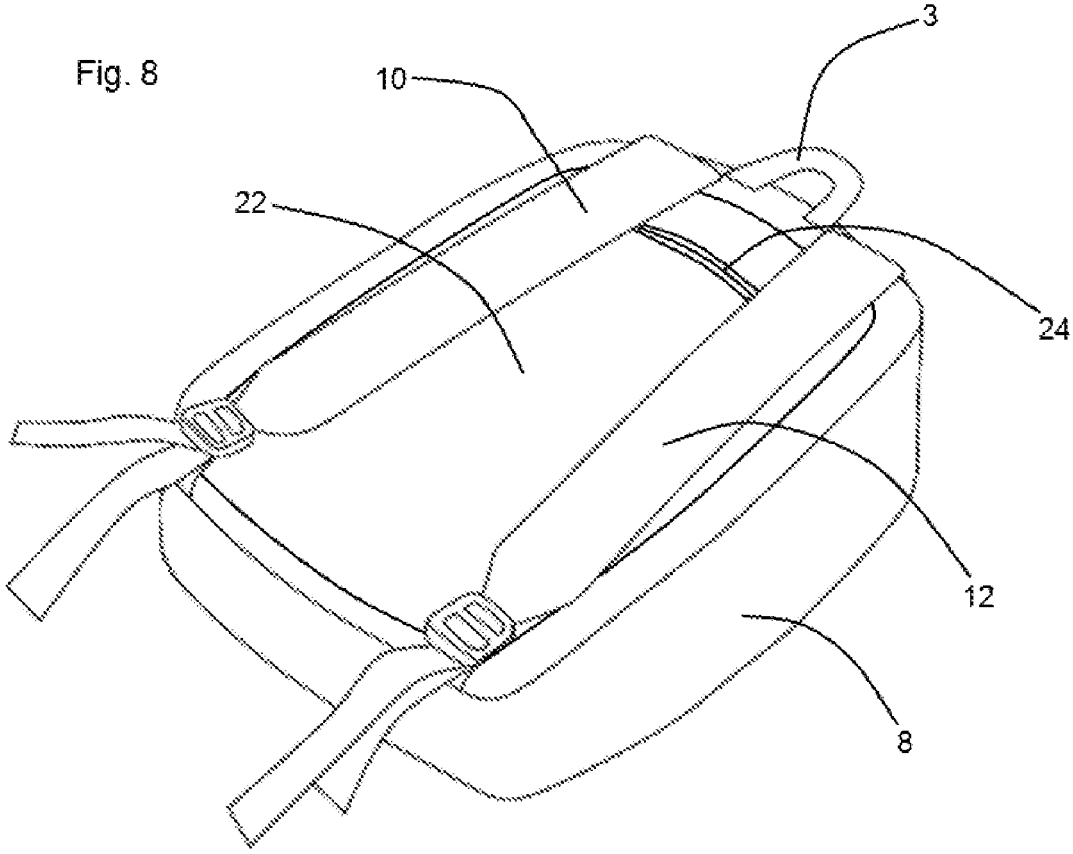

FIG. 8 is a reverse and inverted view of the structure depicted in FIG. 7.

Figure 9:
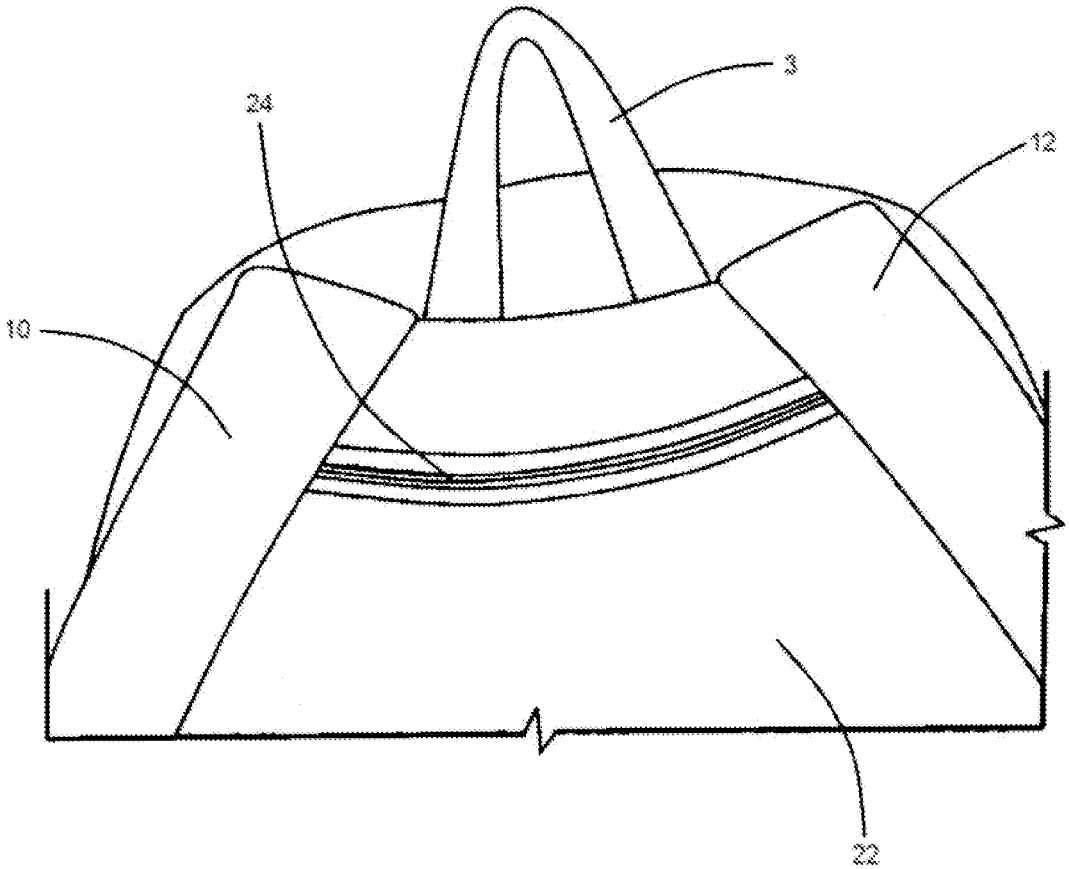

FIG. 9 is a magnified detail of a portion of the structure depicted in FIG. 8.

Figure 10:
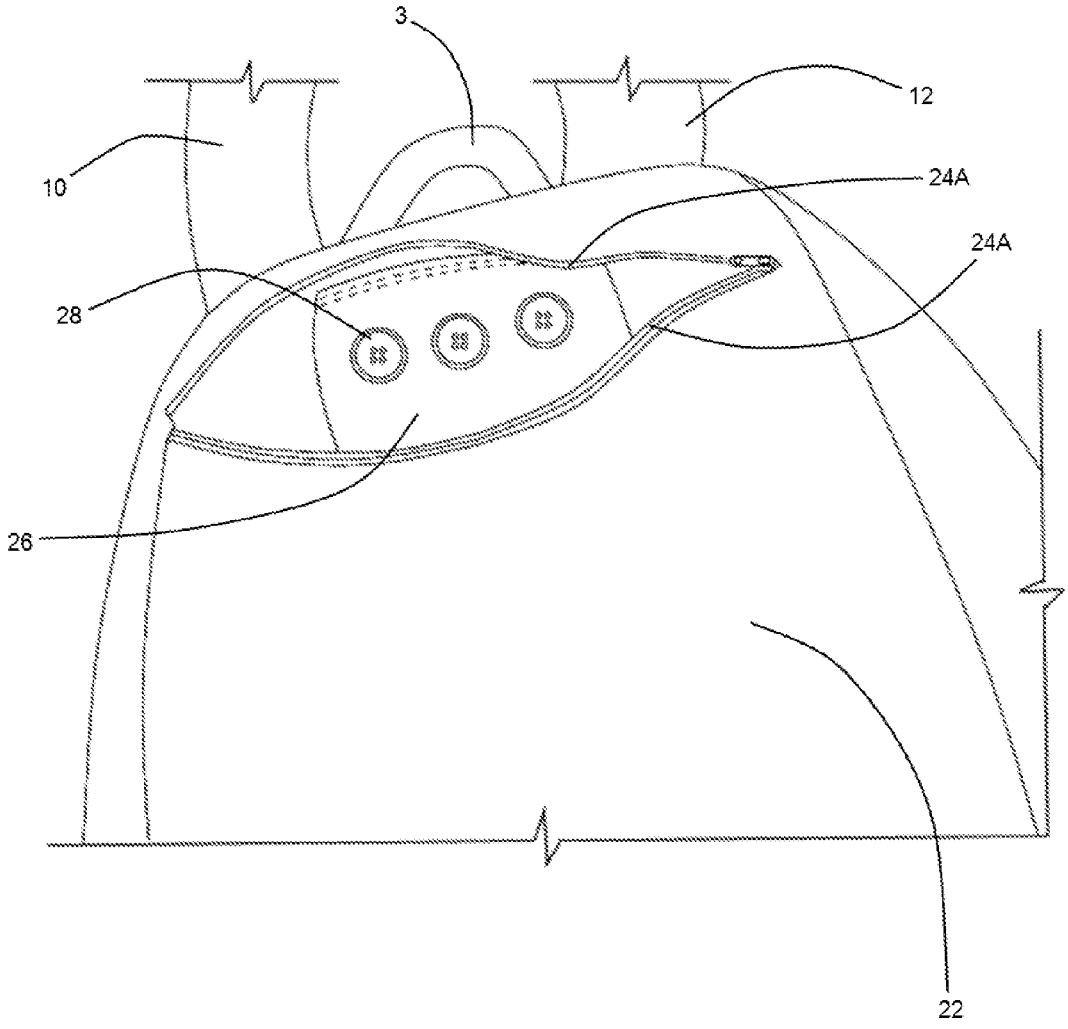

FIG. 10 depicts an alternate configuration of the structure depicted in FIG. 9, the view of FIG. 10 showing shoulder straps released and upwardly extended, and showing pocket zipper opened.

Figure 11:
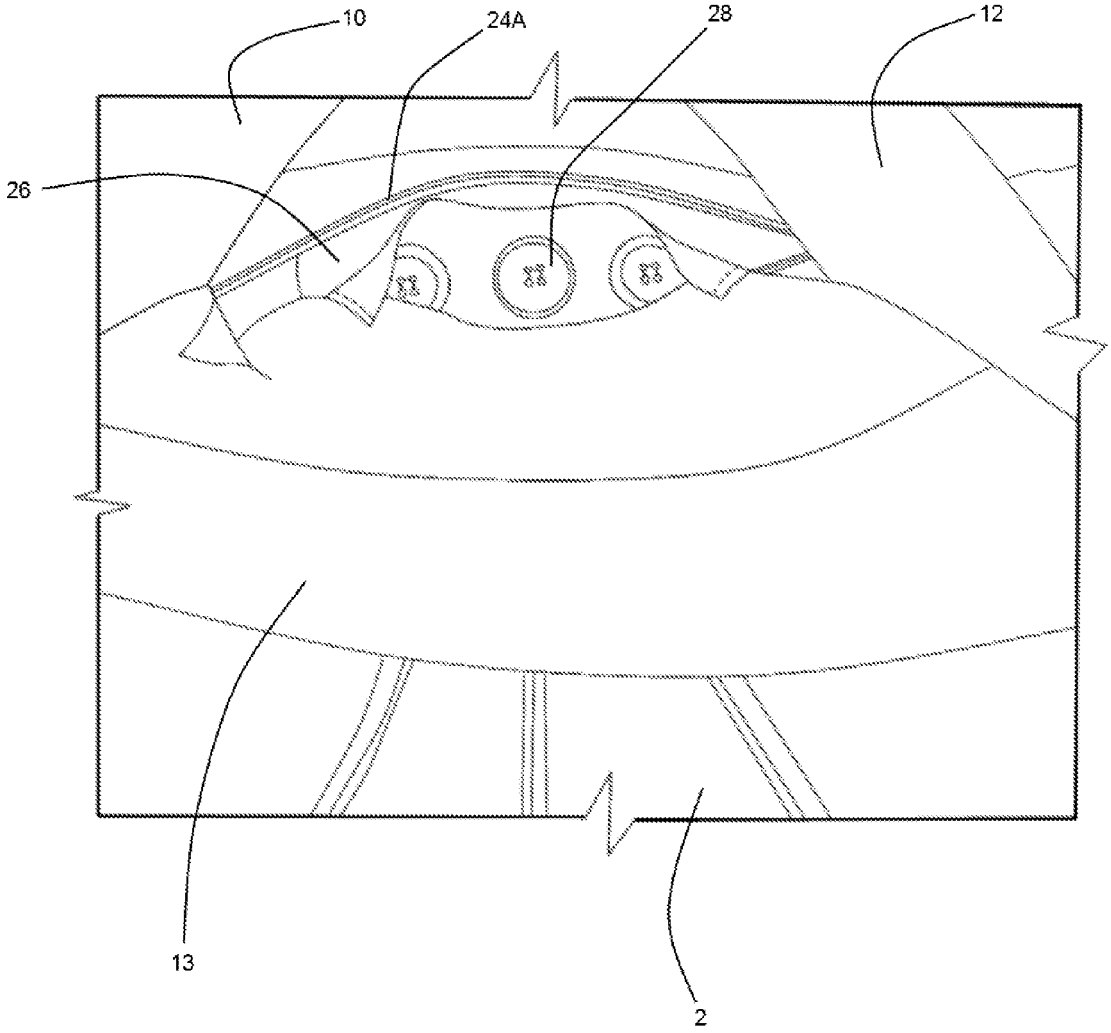

FIG. 11 is a detailed and magnified view of an alternate configuration of the assembly depicted in FIG. 2, the view showing the jacket's collar folded and downwardly extended.

Figure 12:
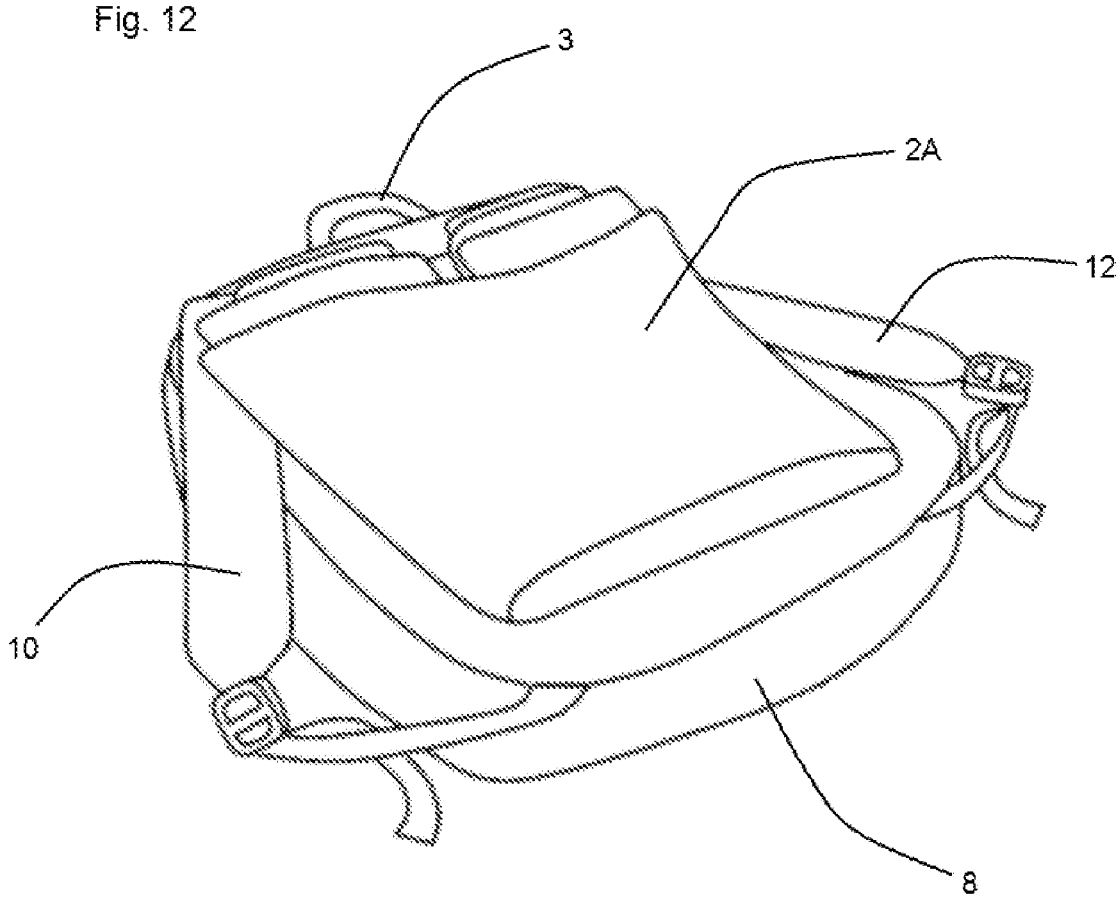

FIG. 12 depicts a combination of the backpack and jacket of the instant inventive assembly, the combination depicting a configuration wherein the jacket portion is folded and is prepared for pocket insertion.

Figure 13:
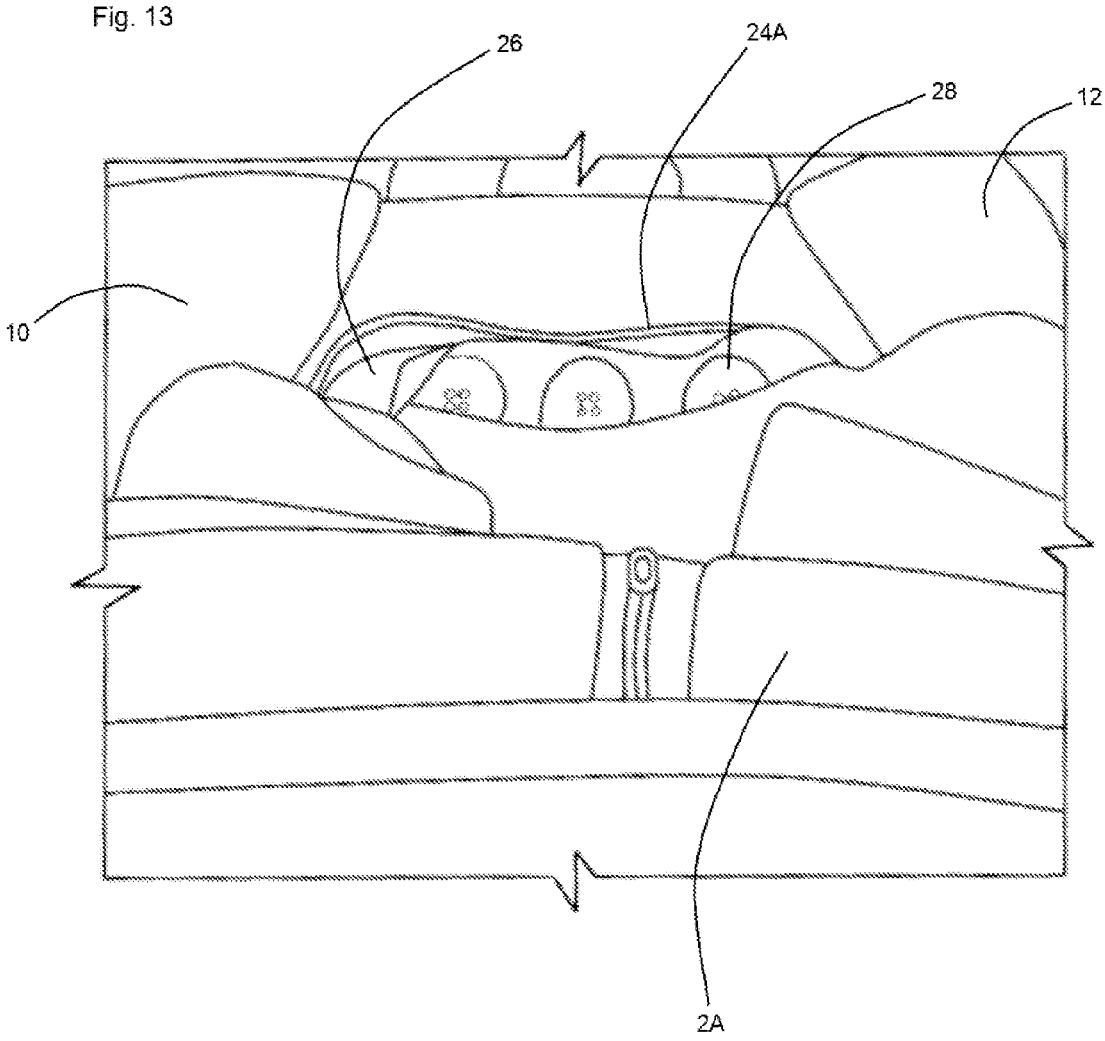

FIG. 13 is a magnified view portraying the interconnection of the jacket and the backpack in FIG. 12.

Figure 14:
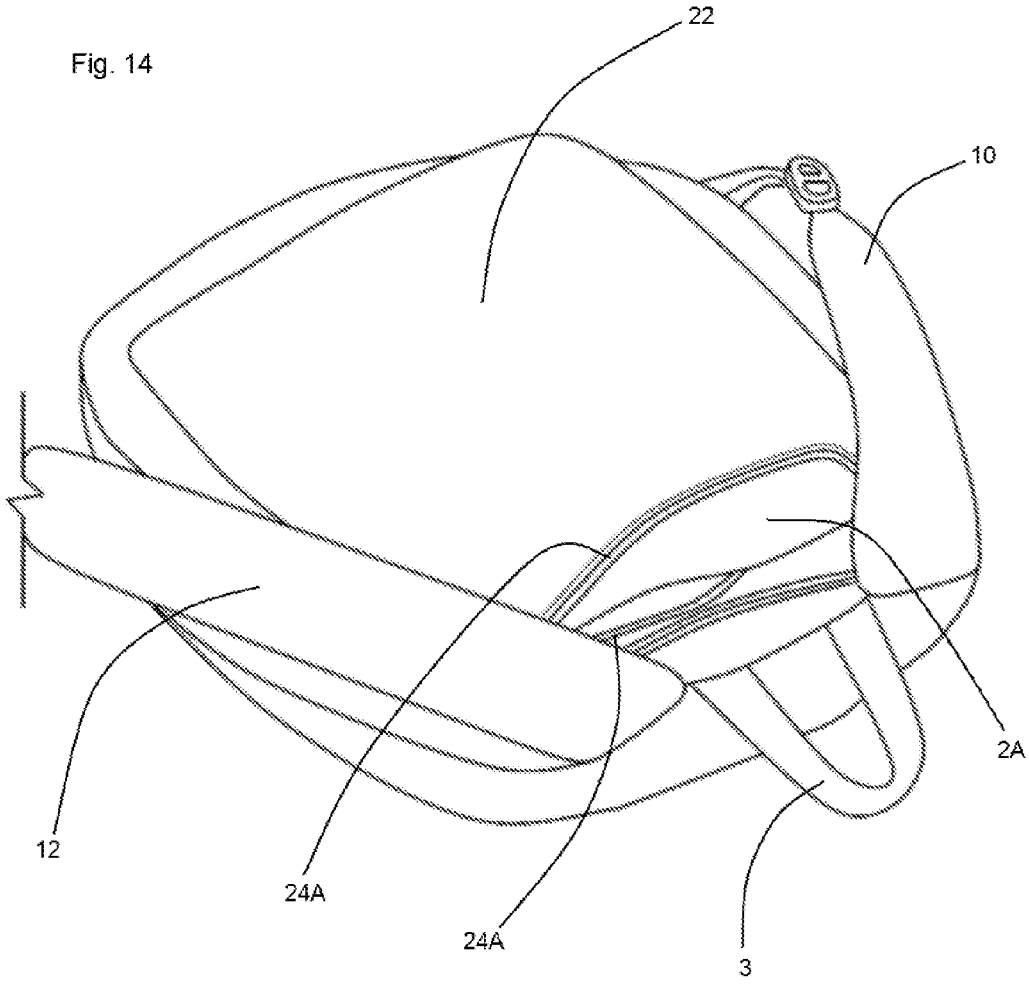

FIG. 14 depicts the backpack having receiving within its jacket receiving pocket the jacket element.

Figure 15:
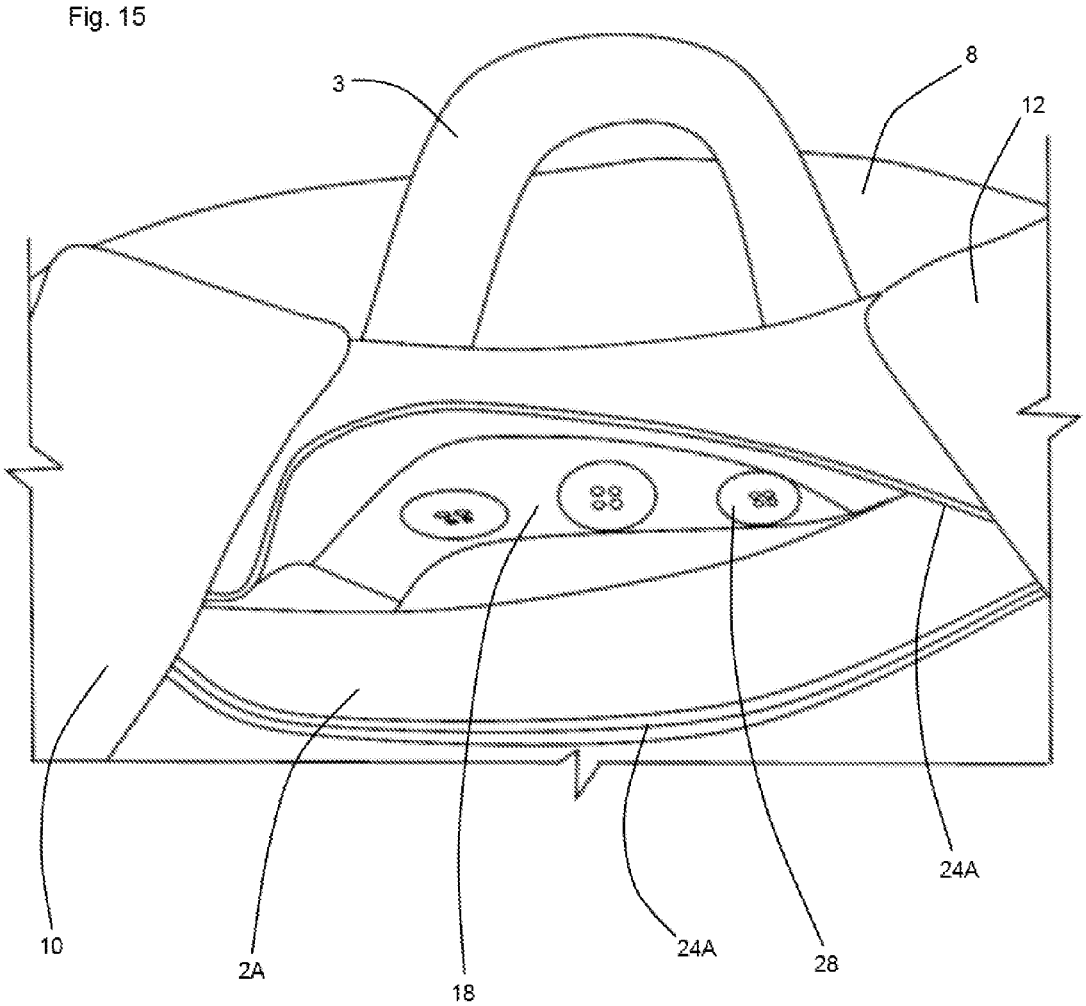

FIG. 15 depicts an interconnection of the jacket and the backpack within the jacket receiving pocket.

Figure 16:
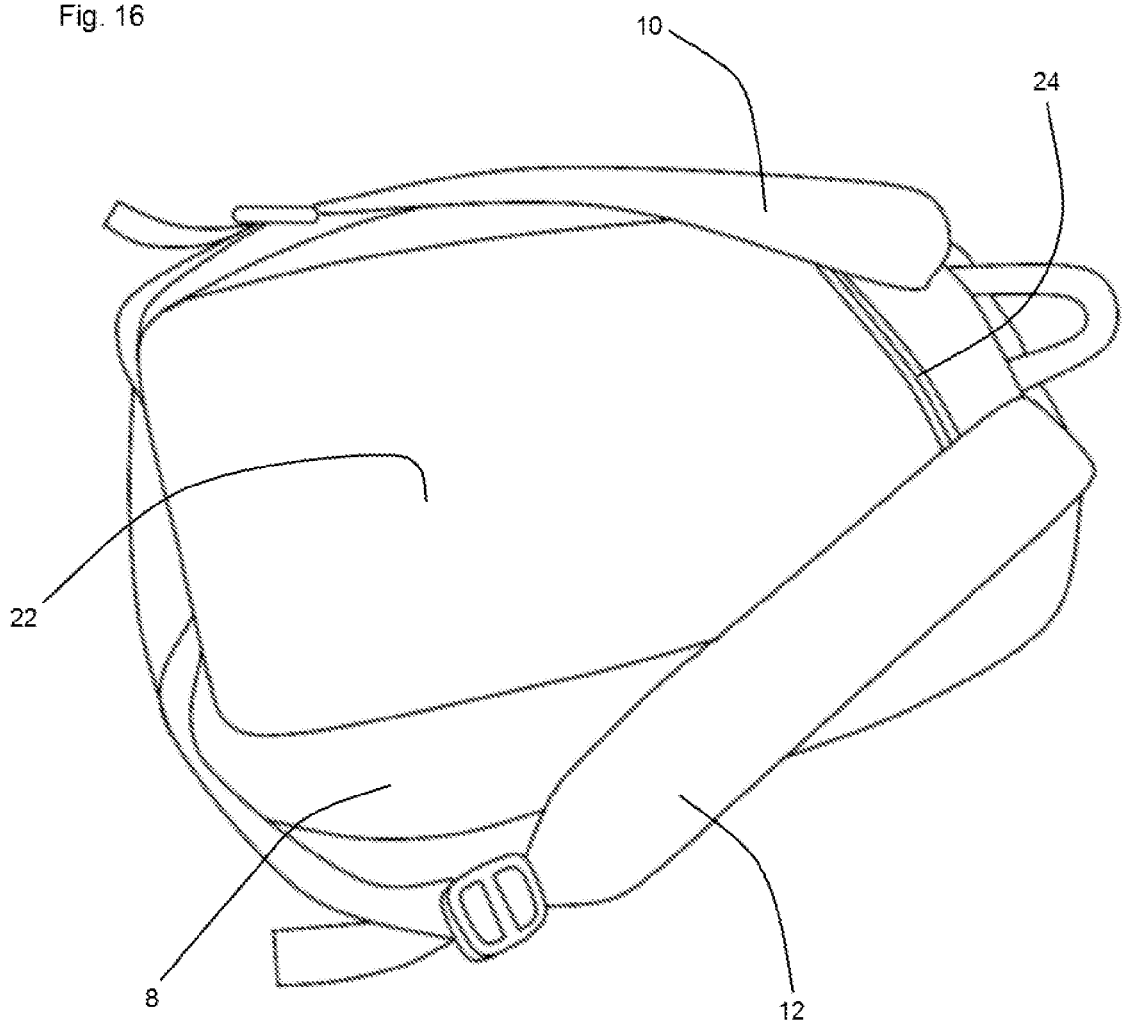

FIG. 16 depicts a final configuration of the jacket and backpack assembly, the view showing the backpack with jacket receiving pocket closed, such pocket containing the jacket.

DETAILED DESCRIPTION OF A PREFERRED EMBODIMENT

Figure 1:
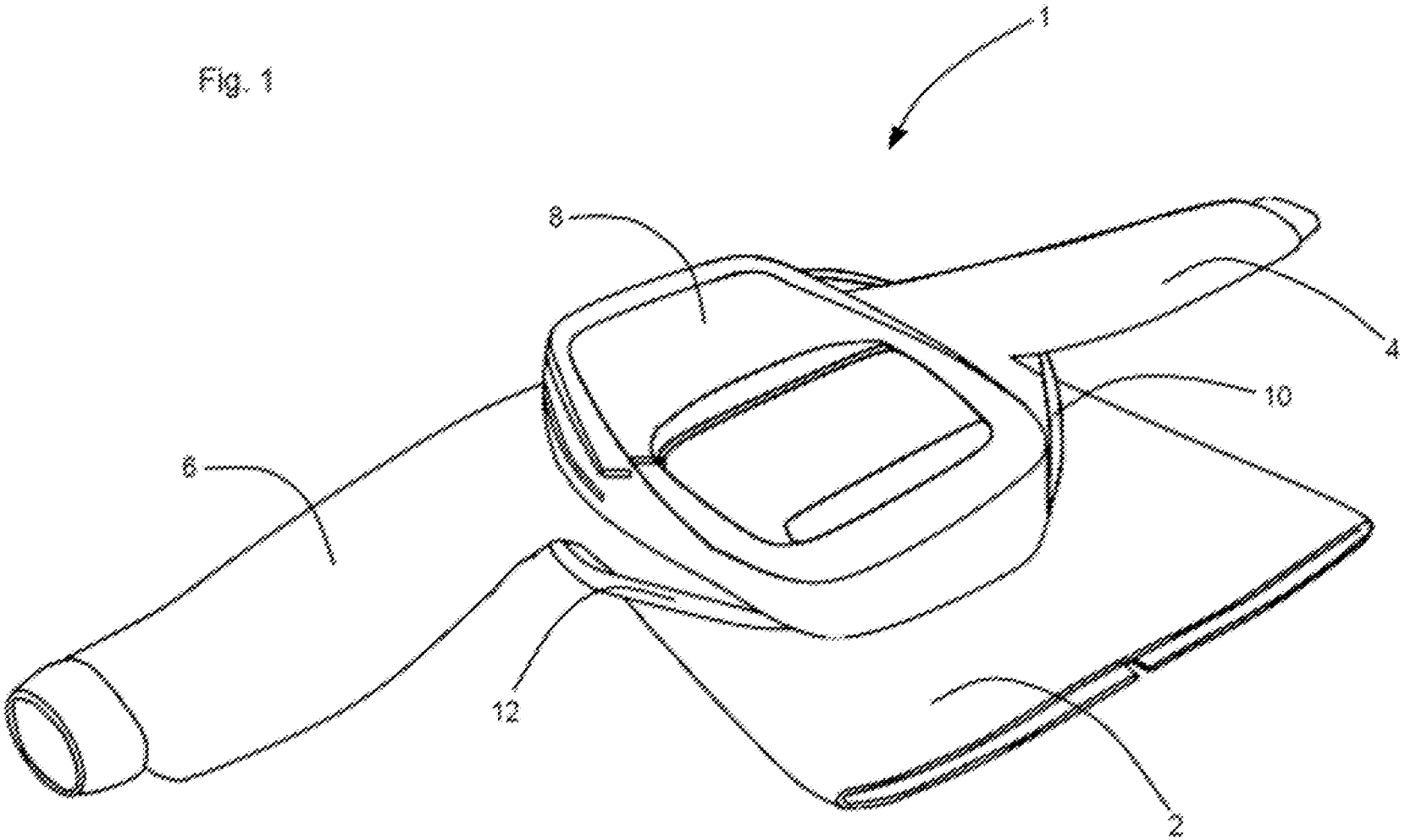
FIG. 1 is a perspective view of the instant inventive jacket and backpack assembly, the view showing the back side of the assembly arranged in a first usage configuration.
Figure 3:
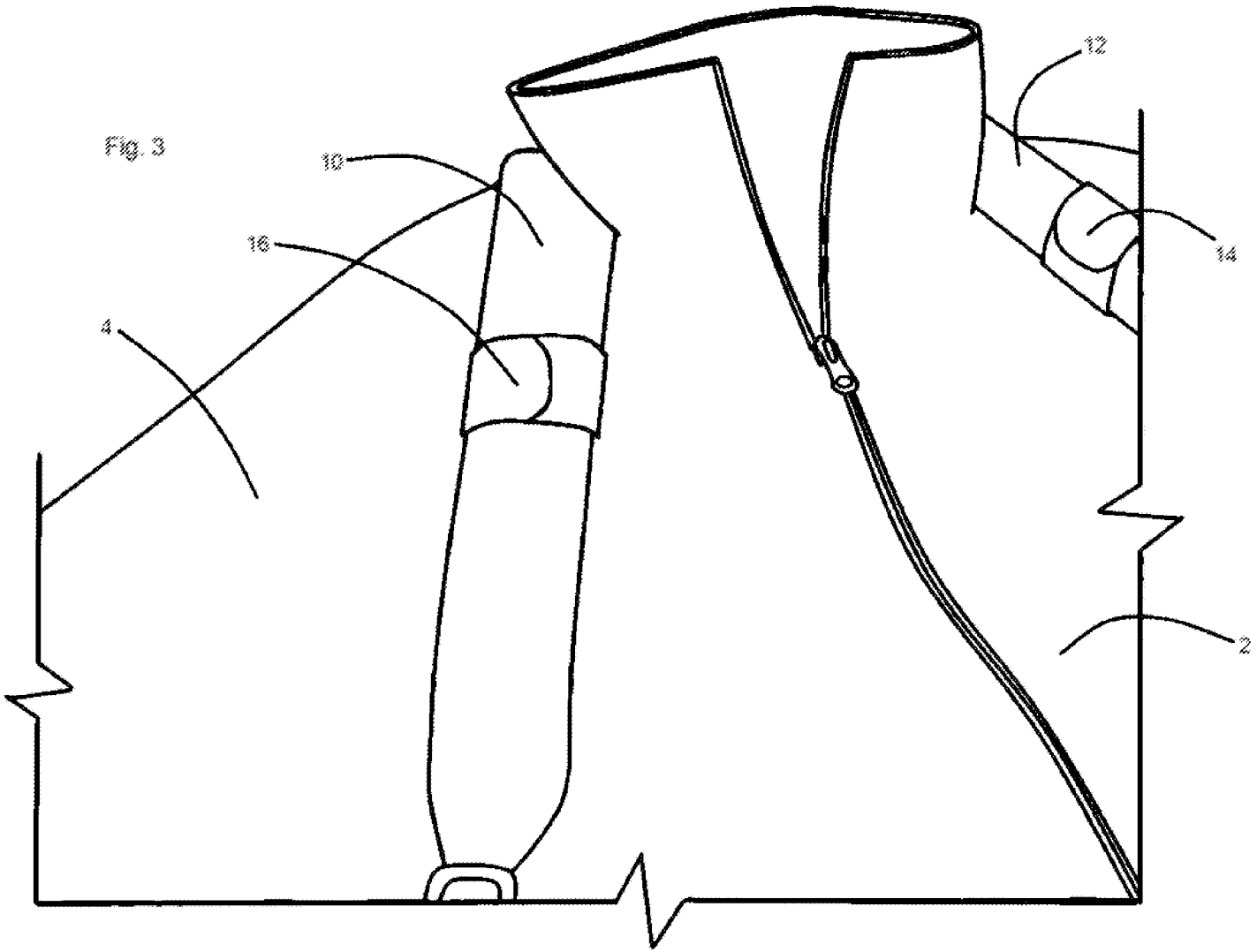
FIG. 3 is a magnified detail of a portion of the view of FIG. 2.

Referring now to the drawings, and in particular to FIG. 1, the instant inventive jacket and backpack assembly is referred to generally by Reference Arrow 1. The jacket and backpack assembly 1 comprises a coat or jacket 2, the coat or jacket 2 having a right arm 4 and left arm 6. Referring further simultaneously to FIGS. 2-4, the coat or jacket 1 preferably further comprises left and right releasable backpack shoulder strap engaging means 14 and 16. Such means preferably comprise, as depicted, releasable flexible hook and loop pad combinations which are fixedly sewn to the anterior aspects of the jacket's left and right shoulders. The coat or jacket 2 preferably further comprises a collar portion 13, such collar portion 13 preferably being of the type which alternately stores and dispenses a hood. Referring further simultaneously to FIGS. 5 and 6, the coat or jacket 2 preferably further comprises a button eye panel or loop 18 which is preferably fixedly sewn to the back of the shoulder portion of the coat or jacket 2, the button eye loop 18 preferably having a plurality of button eyes 20 extending therethrough.

Referring simultaneously to FIGS. 7-9, the backpack portion 8 of the instant inventive assembly preferably comprises right and left shoulder straps 10 and 12 each having, as depicted, a take up buckle at its lower end, and an upper handle/hanging loop 3. A jacket receiving pocket 22 having a zippered upper opening 24 is preferably situated on the back side or the wearer side of the backpack 8, the jacket receiving pocket 22 preferably being substantially co-extensive with the wearer side of the backpack 8. Referring further simultaneously to FIG. 10, zipper 24 may be opened and vertically upwardly and downwardly splayed to the opened configuration 24A depicted in FIG. 10, such opening exposing a button flap or panel 26 and a plurality of buttons 28. The upper end of the button flap 26 is preferably fixedly sewn to an interior wall of the jacket receiving pocket 22, and the buttons 28 are preferably fixedly sewn to the button flap 28.

In use of the instant inventive jacket and backpack assembly, referring to FIG. 8, the backpack 8 may be lain upon a flat surface in the orientation depicted. Thereafter, referring further to FIG. 15, the zipper 24 of the backpack 8 may be opened and the released sides of the zipper 24 may be splayed vertically upwardly and downwardly to the opened configuration 24A depicted in FIG. 15, such configuration exposing for use the button flap 18 and the buttons 28. Thereafter, referring further simultaneously to FIG. 4, the shoulder strap engaging loops 14 and 16 of the coat or jacket 2 may be opened, and the coat or jacket 2 may be lain upon the backpack 8 so that the back of the coat or jacket 2 overlies the shoulder straps 10 and 12. Thereafter, the right and left sleeves 4 and 6 of the coat or jacket 2 may be pulled rightwardly and leftwardly beneath shoulder straps 10 and 12, orienting the coat or jacket 2 with respect to the backpack 8 as depicted in FIG. 2. Thereafter, the shoulder strap engaging loops 14 and 16 may be respectively closed over shoulder straps 12 and 10 as depicted in FIG. 2, such loops securely positioning the coat or jacket 2 in the depicted position with respect to the backpack 8. Thereafter, referring simultaneously to FIGS. 11, 6, and 10, the collar 13 of the coat or jacket 2 may be folded downwardly, and the button eye loop 18 may be oriented and aligned over button flap 26. Thereafter, buttons 28 may be manually extended through button eyes 20 to further securely interconnecting the jacket or coat 2 and the backpack 8.

Referring simultaneously to FIGS. 2, 8, and 11, while the coat or jacket portion 2 and the backpack portion 8 of the instant inventive assembly are interconnected, as depicted in FIG. 2, a user of the assembly may wear the assembly 1 in the manner of a common coat or jacket, donning the jacket and simultaneously donning the backpack 8, or alternately, hanging the assembly 1 upon a coat hook from loop 3 and simultaneously storing both the jacket portion and the backpack portion. Use of the assembly in such fashion advantageously assists children in the ordinarily cumbersome processes of donning and removing the backpack, and such usage advantageously prevents undesirable separations of the backpack and the jacket.

In an alternate usage configuration of the instant inventive jacket and backpack assembly, referring simultaneously to FIGS. 2, 3, and 11, shoulder strap engaging loops 14 and 16 are released, while buttons 28 of button flap 26 remain in buttoned engagement with button eye loop 18. Thereafter, referring further simultaneously to FIGS. 12 and 13, right and left arms 4 and 6 may be drawn respectively leftwardly and rightwardly from beneath shoulder straps 10 and 12, and the coat or jacket 2 may compactly and rectangularly folded to assume the cushion or pad configuration 2A depicted in FIG. 12. Thereafter, referring further simultaneously to FIGS. 14 and 15, the lower portion of the rectangularly folded coat or jacket 2A may be drawn upwardly toward the zippered opening 24A of the jacket receiving pocket 22, and such lower portion of jacket 2A may be extended inwardly and downwardly through such opening to extend the lower end of such jacket downwardly into the interior of the jacket receiving pocket 22, causing the cushion configured coat or jacket 2A to be received within and contained within the jacket receiving pocket 22 as depicted in FIG. 14. Thereafter, referring further simultaneously to FIG. 16, the splayed zipper 24A may be closed, causing the closed zipper 24 to securely contain the coat or jacket 2A within the interior of the jacket receiving pocket 22. While the coat or jacket 2A is contained within the interior of the jacket receiving pocket 22, the coat or jacket 2A advantageously functions as a back cushion, preventing other items contained within the backpack 8 such as books, notebooks, pencils, pencil boxes, and the like from uncomfortably gouging against the wearer's back. The assembly, as configured in FIG. 16, may be advantageously worn by school children during fall or spring seasons when warm weather at the beginning of a school day may unexpectedly turn cold. In such event, a school child using the inventive assembly may simply, referring simultaneously to all figures, open zipper 24, extract the coat or jacket 2A upwardly from the interior of the jacket receiving pocket 22, and through the opening 24. Thereafter, the jacket 2A may be unfolded and the jacket's right and left arms 4 and 6 may be extended rightwardly and leftwardly beneath shoulder straps 10 and 12. Thereafter, the child may wrap velcro strap loops 16 and 14 about the right and left shoulder straps 10 and 12, securing such loops about such straps. Thereafter, the child may don both the jacket portion 2 and the backpack portion 8 of the assembly 1 in the manner common to ordinary coats and jackets.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A storage and clothing assembly comprising:

(a) a jacket comprising a shoulder covering section, the shoulder covering section having a right side, a left side, a front side, a back side, and a lower end, the jacket further comprising a right arm, a left arm, and a torso section, the left and right arms being respectively fixedly attached to the shoulder covering section's left and right sides, and the torso section being fixedly attached to the shoulder covering sections lower end, the jacket being foldably moveable between a wearing configuration and a compactly folded backpack cushioning configuration; and (b) a backpack having a wearer side, a left shoulder strap, a right shoulder strap, and a pocket, the pocket having an upper opening, the pocket having a plurality of interior walls, the pocket being positioned at the backpack's wearer side, and the pocket being fitted for slidably receiving the jacket while the jacket is in its backpack cushioning configuration, the left and right shoulder straps being positioned for slidably receiving the jacket's left and right arms while the jacket is in its wearing configuration;

(c) releasable attaching means connected operatively to the jacket and to the backpack at a pair of points, a first point among the pair of points being on the back side of the jacket's shoulder covering section, a second point among the pair of points being on an interior wall among the pocket's plurality of interior walls; and (d) means for alternate opening and closing, the means for alternately opening and closing being connected operatively to the backpack pocket's upper opening, the means for alternate opening and closing being adapted for alternately opening the backpack's pocket for slidable extraction and foldable movement of the jacket to its wearing configuration and, upon opposite foldable movement of the jacket to its backpack cushioning configuration and upon subsequent slidable insertion of the folded jacket into the backpack's pocket, securing the folded jacket within the pocket.

2. The storage and clothing assembly of claim 1 wherein the means for alternate opening and closing comprises a fastener selected from the group consisting of zippers, snap fasteners, flexible hook pad and hook engaging loop pad combinations, button and button hole combinations, hook and eye combinations, and magnet fasteners.

3. The storage and clothing assembly of claim 2 wherein the jacket comprises a hooded wind breaker.

4. The storage and clothing assembly of claim 3 wherein the backpack's left and right shoulder straps respectively comprise left and right take up buckles.

5. The storage and clothing assembly of claim 4 wherein the backpack comprises at least a first upwardly opening storage compartment positioned rearwardly from the backpack's pocket.

* * * * *